US010308336B1

(12) United States Patent
Vermeulen

(10) Patent No.: US 10,308,336 B1
(45) Date of Patent: Jun. 4, 2019

(54) WATERCRAFT PROPULSION SYSTEM

(71) Applicant: Christopher Leonard Vermeulen, The Blue Mountains (CA)

(72) Inventor: Christopher Leonard Vermeulen, The Blue Mountains (CA)

( * ) Notice: Subject to any disclaimer, the term of this patent is extended or adjusted under 35 U.S.C. 154(b) by 0 days.

(21) Appl. No.: 16/184,945

(22) Filed: Nov. 8, 2018

(51) Int. Cl.
*B63H 5/14* (2006.01)
*B63H 5/15* (2006.01)
*B63H 5/16* (2006.01)
*B63B 35/79* (2006.01)

(52) U.S. Cl.
CPC ..... *B63H 5/15* (2013.01); *B63B 35/7923* (2013.01); *B63B 35/7943* (2013.01); *B63H 5/14* (2013.01); *B63H 5/16* (2013.01)

(58) Field of Classification Search
CPC ..... B63B 35/73; B63B 35/79; B63H 5/00; B63H 5/14; B63H 21/00; B63H 21/17; B63H 21/21; A63B 35/00; A63B 35/12
USPC ..... 114/55.56, 315; 440/38; 441/65, 74, 79
See application file for complete search history.

(56) References Cited

U.S. PATENT DOCUMENTS 3,630,165 A * 12/1971 Bottger ..... A63B 35/12 114/315
3,890,920 A * 6/1975 Buelk ..... A63B 35/12 114/315
5,105,753 A * 4/1992 Chih ..... A63B 35/12 114/315
5,388,543 A * 2/1995 Ditchfield ..... A63B 35/12 114/315
6,004,173 A * 12/1999 Schott ..... B63H 11/103 440/38
7,207,282 B1 * 4/2007 Ruan ..... B63B 35/7943 114/55.56
9,359,044 B2 * 6/2016 Langelaan ..... B63H 21/17
9,586,659 B2 3/2017 Langelaan

* cited by examiner

*Primary Examiner* — Lars A Olson
(74) *Attorney, Agent, or Firm* — Gulf Coast Intellectual Property Group

(57) ABSTRACT

A watercraft propulsion system operably coupled to a watercraft wherein the propulsion system includes a housing assembly having a first housing and a second housing movable with respect to each other so as to provide an operational mode and a standby mode. The first housing includes at least one aperture that is configured to provide access to the interior volume of the first housing. The second housing includes at least one aperture configured to provide access to the interior volume of the second housing. In the operational mode the first housing and second housing are positioned so as to facilitate alignment of the at least one apertures formed therein. In the standby mode the first housing and second housing are positioned so as to provide an offset of the least one apertures. The first housing is movably mounted within the interior volume of the second housing.

20 Claims, 4 Drawing Sheets

WATERCRAFT PROPULSION SYSTEM

PRIORITY UNDER 35 U.S.C SECTION 119(E) & 37 C.F.R. SECTION 1.78

This nonprovisional application claims priority based upon the following prior U.S. Provisional Patent Application entitled: Watercraft and Propulsion System, Application No. 62/740,362 filed Oct. 2, 2018 in the name of Chris Vermeulen, which is hereby incorporated by reference for all purposes.

FIELD OF INVENTION

The present invention relates generally to watercraft propulsion systems, more specifically but not by way of limitation, a watercraft propulsion system that can be operably coupled to a vessel such as but not limited to a surfboard wherein the propulsion system includes an operational mode and a standby mode and wherein the standby mode inhibits access to the impeller of the propulsion system.

BACKGROUND

Personal water craft (PWC) vehicles have enjoyed immense popularity in recent years. PWCs generally allow one, two or more riders to sit, kneel or stand on the craft and to ride across the surface of a body of water. The popularity of PWCs is also attributable to the considerations that they are less expensive than traditional power boats, are more easily transported over land by smaller trailers, and storage and maintenance of the PWCs is generally simpler than with full size power boats. Other popular personal watercraft include vessels such as but not limited to surfboards and powered surfboards. Alternative models of surfboards are gaining in popularity such as but not limited to hydrofoil surfboards. The purpose of hydrofoils on surfboards is typically to enable higher speeds, ability to ride waves faster and longer, and provide a smoother experience by the hydrofoil lifting the surfboard above the choppy and turbulent surface water.

Powered surfboards and hydrofoil surfboards have begun to enter the market. These devices typically utilize a jet propulsion system that is operably coupled to either the bottom surface of the surfboard or to the hydrofoil assembly. One issue with existing technology is the exposure to the impeller/propeller of the propulsion system. All designs of jet propulsion system employ the use of an impeller/propeller that functions to provide an intake of water and than direct the water outward as a stream of that is operable to propel the watercraft. Access to the impeller/propeller is often uninhibited, which presents a safety hazard to a user especially for a watercraft where a user is consistently proximate the propulsion system such as but not limited to a powered surfboard.

Accordingly, there is a need for a watercraft propulsion system wherein the propulsion system is configured to have a standby mode and an operational mode wherein in the standby mode the impeller is inaccessible.

SUMMARY OF THE INVENTION

It is the object of the present invention to provide a watercraft propulsion system operably coupled to a watercraft such as but not limited to a surfboard wherein the surfboard has a standard bottom hull design or further has a hydrofoil assembly secured to the bottom thereof.

Another object of the present invention is to provide a watercraft propulsion system coupled to a watercraft such as but not limited to a surfboard wherein the propulsion system is a jet propulsion system.

A further object of the present invention is to provide a watercraft propulsion system configured to be secured to a watercraft such as but not limited to a surfboard wherein the propulsion system includes a first housing and a second housing.

Still another object of the present invention is to provide a watercraft propulsion system wherein the first housing includes a first portion and a second portion and wherein the first housing has an intake aperture intermediate the first portion and second portion.

An additional object of the present invention is to provide a watercraft propulsion system configured to propel a watercraft such as but not limited to a surfboard wherein the first housing has disposed therein a motor, a shaft and an impeller.

Yet a further object of the present invention is to provide a watercraft propulsion system wherein the second housing is configured to receive therein the first housing.

Another object of the present invention is to provide a watercraft propulsion system configured to operate a watercraft such as but not limited to a surfboard wherein the second housing is movably secured to the first housing.

An alternate object of the present invention is to provide a watercraft propulsion system wherein the second housing further includes a first portion, a second portion and an intake aperture intermediate thereto.

Still a further object of the present invention is to provide a watercraft propulsion system wherein in the operational mode the intake aperture of the second housing is aligned with the intake aperture of the first housing so as to allow water flow thereinto.

An additional object of the present invention is to provide a watercraft propulsion system coupled to a watercraft such as but not limited to a surfboard wherein in the standby mode the first housing and second housing are slidably positioned such that the intake apertures are not aligned inhibiting access to the interior volume of the first housing.

A further object of the present invention is to provide a watercraft propulsion system wherein the impeller is inaccessible in the standby mode and wherein the watercraft is being propelled by a source other than the watercraft propulsion system.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
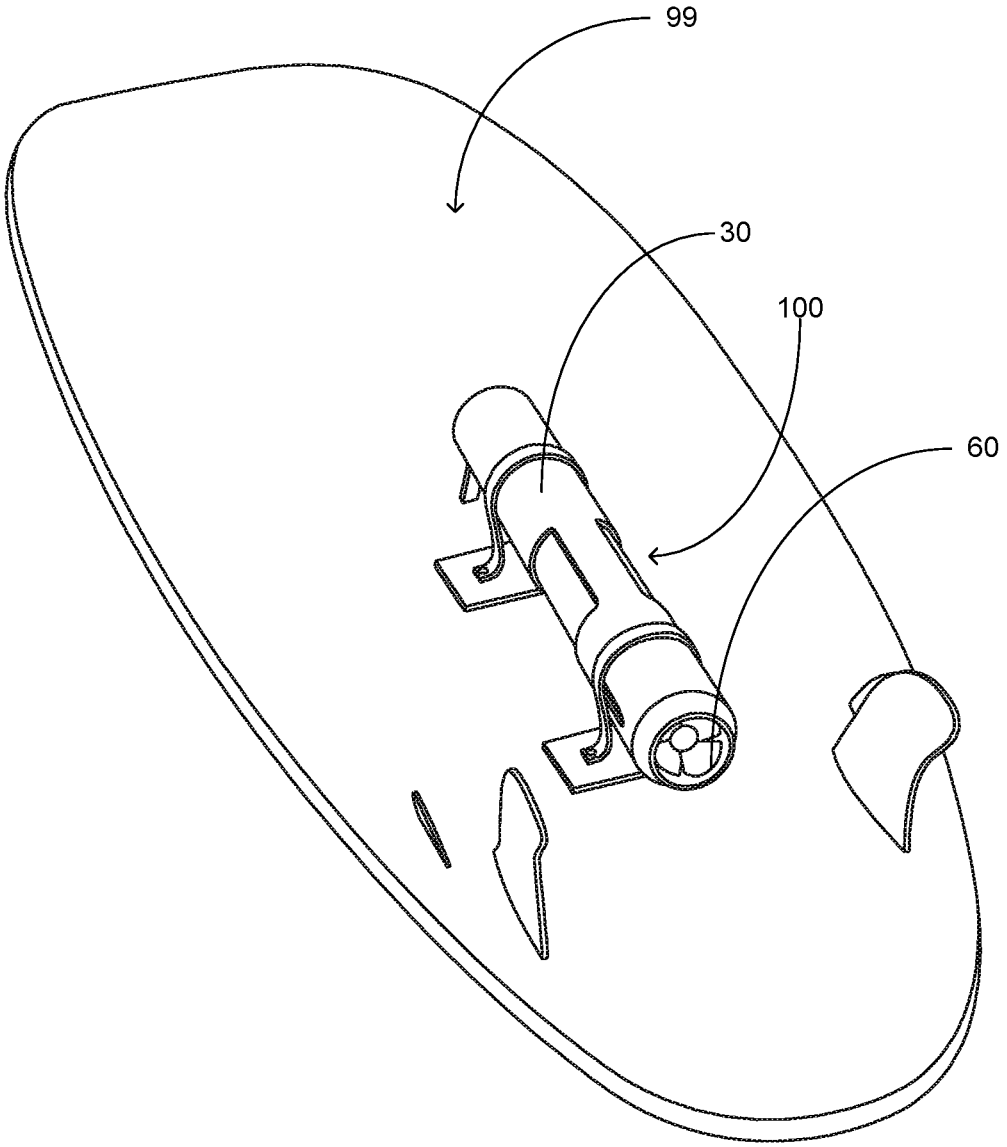
FIG. 1 is a bottom view of an exemplary watercraft having the propulsion system of the present invention.
Figure 2:
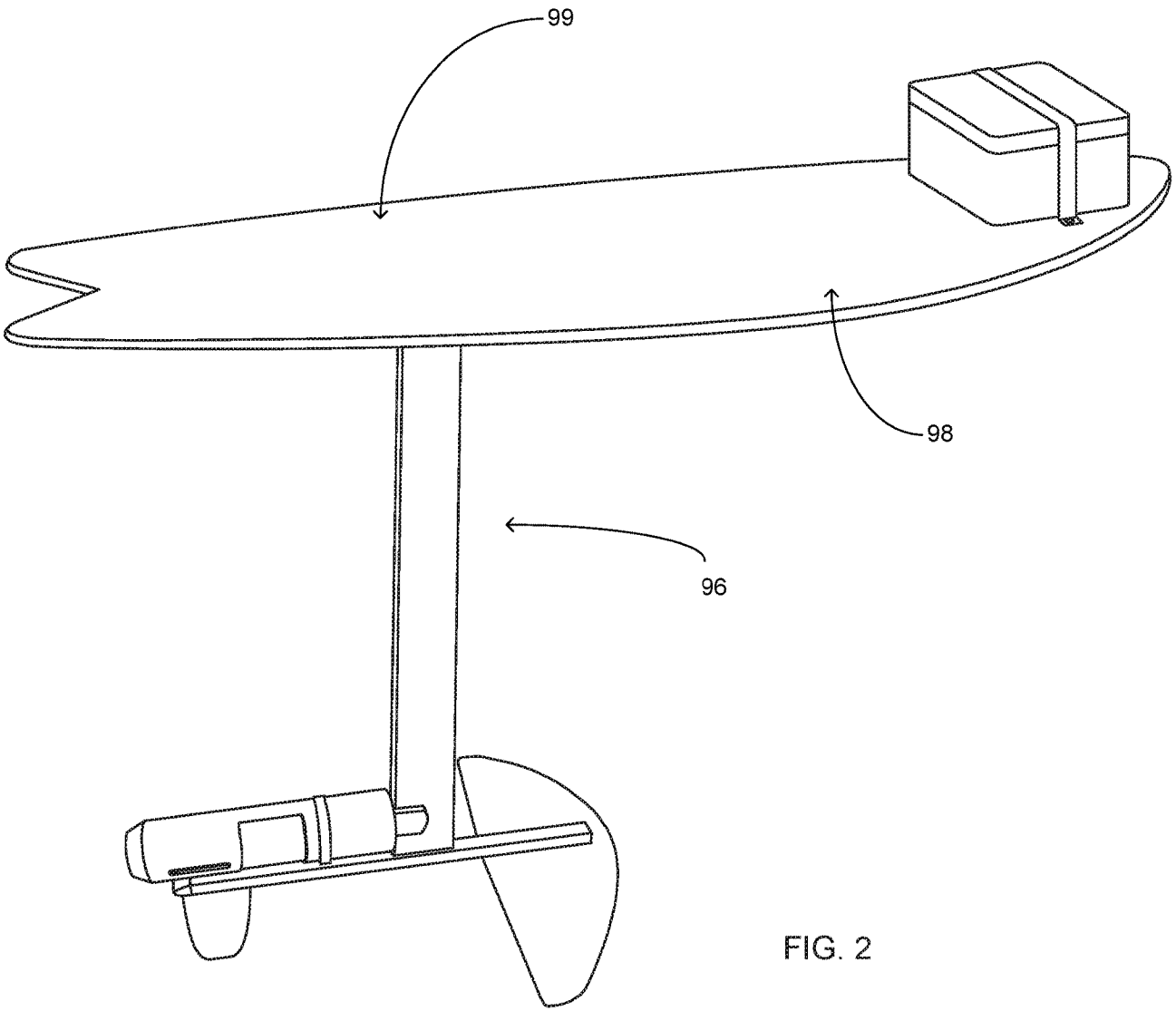
FIG. 2 is perspective view of an exemplary watercraft having the propulsion system of the present invention.
Figure 3:
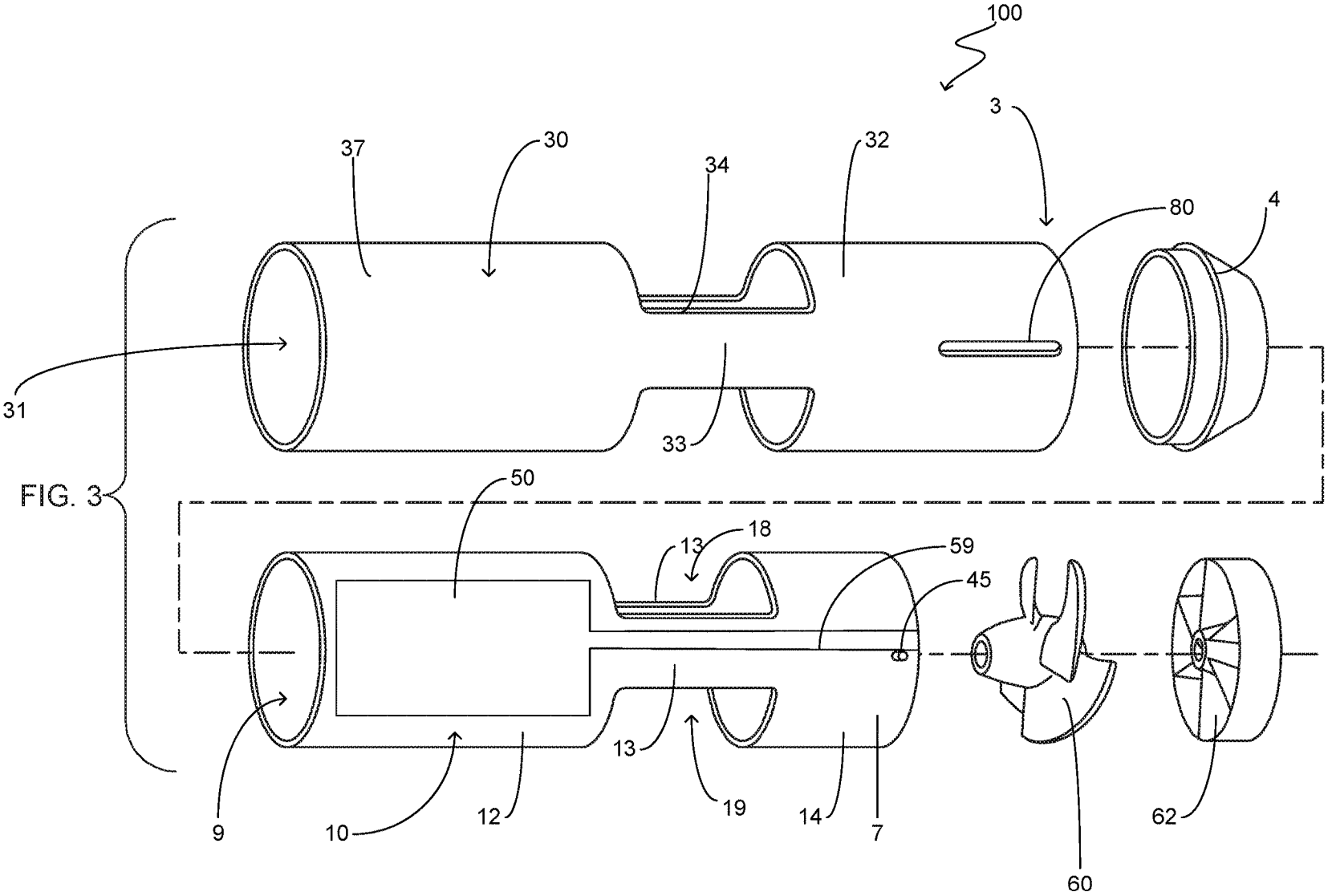
FIG. 3 is an exploded view of the propulsion system of the present invention.
Figure 4:
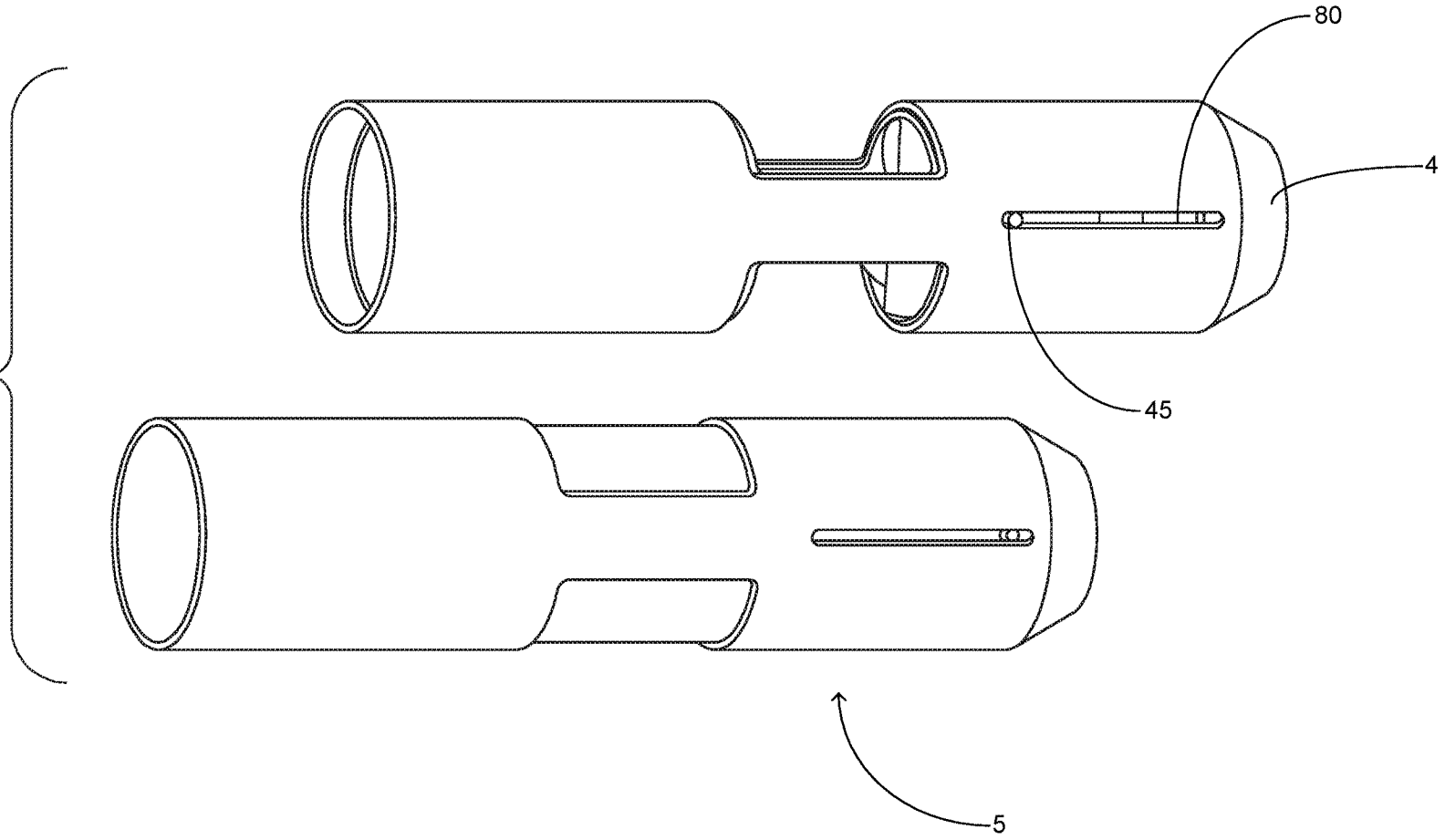
FIG. 4 is a perspective view of the propulsion system and the position of the first housing and second housing in the operational mode and standby mode of the present invention.

Referring now to the drawings submitted herewith, wherein various elements depicted therein are not necessarily drawn to scale and wherein through the views and figures like elements are referenced with identical reference numerals, there is illustrated a watercraft propulsion system 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Now referring to the Figures submitted as a part hereof, the watercraft propulsion system 100 includes a housing assembly 5. The housing assembly 5 includes a first housing 10 and a second housing 30. As will be further discussed herein, the first housing 10 is movably coupled to the second housing 30. The first housing 10 is manufactured from a durable suitable material such as but not limited to aluminum. The first housing 10 includes a first portion 12 and a second portion 14 integrally formed having support members 13 intermediate thereto. The first housing 10 is cylindrical in shape and it is contemplated within the scope of the present invention that the first housing 10 could be manufactured in alternate sizes. The first housing 10 has a diameter that is configured so as to allow the first housing 10 to be movably disposed within the interior volume 31 of the second housing 30. The first portion 12 of the first housing 10 includes an interior volume 9 that is of suitable size to accommodate a motor 50 therein. The motor 50 of the watercraft propulsion system 100 is a direct current electric motor that is powered by a power source such as but not limited to a lithium ion battery. It is contemplated within the scope of the present invention that the motor 50 could have various output ratings so as to achieve the desired objective of propelling a watercraft to which the watercraft propulsion system 100 is operably coupled.

The support members 13 are positioned perpendicular to the first portion 12 and second portion 14 of the first housing 10 and are diametrically opposed. The aforementioned orientation of the support members 13 forms a first aperture 18 and a second aperture 19 wherein the first aperture 18 and second aperture 19 allow water to flow into the interior volume 9 of the first housing 10 an subsequently be directed towards impeller 60. While the embodiment illustrated herein has two support members 13 diametrically opposed on the first housing 10, it is contemplated within the scope of the present invention that the first housing 10 could have as few as one support member 13 or more than two support members 13 and as such create as few as one aperture or more than two apertures providing water flow into the interior volume 9 of the first housing 10. It should be further understood within the scope of the present invention that the first aperture 18 and second aperture 19 could be formed in numerous alternate sizes so as to provide a desired volume of water flow therethrough. The impeller 60 is a conventional marine impeller that is configured to provide an intake of water through the first aperture 18 and second aperture 19 and direct a stream of water outwards from the housing assembly 5 through nozzle 4. The impeller 60 is rotatably coupled to the motor 50 utilizing shaft 59. Rearward from the impeller 60 is impeller guard 62 wherein the impeller guard 62 is formed from a durable material such as but not limited to metal and is structured to inhibit access to the impeller 60 from the rear 3 of the housing assembly 5.

Secured to the outer surface 7 of the second portion 14 of first housing 10 is alignment rod 45. Alignment rod 45 is manufactured from a durable material such as but not limited to metal and extends outward from and is perpendicular to the second portion 14 of the first housing 10. While not particularly illustrated herein, it should be understood within the scope of the present invention that the first housing 10 includes a second alignment member diametrically opposed on the second portion 14 of the first housing 10. The alignment rod 45 is configured to couple with slot 80 of the second housing 30 and is operable to ensure maintenance of axial alignment of the first housing 10 and second housing 30 during the movement of the second housing 30 as is further discussed herein. It is contemplated within the scope of the present invention that the first housing 10 could have no alignment rod 45 or more than 2 alignment rods. It is contemplated within the scope of the present invention that the second housing 30 could be movable with respect to the first housing 10 in either a linear or rotational direction.

The second housing 30 is formed in a mateable shape so as to receive therein the first housing 10. The second housing 30 includes first portion 37, second portion 32 having structural members 33, 34 therebetween. The first portion 37, second portion 32 and structural members 33, 34 are integrally formed utilizing suitable durable techniques. A first aperture 36 and second aperture 37 are present intermediate the first portion 37 and second portion 32 and are configured to be of similar size as the first aperture 18 and second aperture 19 of the first housing 10. The first housing 10 is movably mounted within the second housing 30 wherein in the operational mode of the present invention the first housing 10 is positioned within the second housing 30 so as to provide alignment of the first aperture 18 and second aperture 19 of the first housing 10 and the first aperture 36 and second aperture 37 of the second housing 30. In the operational mode, the motor 50 is applying power to the impeller 60 resulting in rotation thereof. The alignment of the first aperture 18 and second aperture 19 of the first housing 10 and the first aperture 36 and second aperture 37 of the second housing 30 provides water flow into the housing assembly 5 and as such provide power to propel a watercraft 99 to which the watercraft propulsion system 100 is operably coupled. While not particularly illustrated herein, it is contemplated within the scope of the present invention that the second housing 30 could have secured thereto proximate the first aperture 36 and/or the second aperture 37 water introduction members. The water introduction members would be movable intermediate a first position and a second position wherein the purpose of the water introduction members would be to assist in the direction of water into the first aperture 36 and second aperture 37 during the operational mode of the present invention. It should be understood within the scope of the present invention that the water introduction members could be formed in alternate shapes and sizes so as to accomplish the desired task of increasing the water flow into the first aperture 36 and second aperture 37.

In the standby mode of the present invention, the first housing 10 is moved to a position such that the first aperture 36 and second aperture 37 of the second housing 30 are blocked by the second portion 14 of the first housing 10. In this position no power is being applied to the impeller 60 and as a result the first housing 10 has slidably moved to the aforementioned position inhibiting access to the impeller 60 and the first aperture 36 and second aperture 37 of the second housing 30. It is contemplated within the scope of the present invention that the standby mode is provided so as to increase the operational safety of the watercraft 99 to which the watercraft propulsion system 100 is operably coupled. Additionally, as a preferred watercraft 99 for the watercraft propulsion system 100 is an exemplary surfboard 98, in the standby mode the exemplary surfboard could be powered by a wave so as to provide increased usage for the power source providing electrical power to the exemplary surfboard. It is contemplated within the scope of the present invention that the watercraft propulsion system 100 could be operably coupled to various types of watercraft 99. Furthermore, the watercraft propulsion system 100 could be operably coupled to a watercraft 99 having a hydrofoil assembly 96.

As previously stated herein, it should be understood within the scope of the present invention that the first housing 10 and second housing 30 could be movable with respect to each other in either a linear or rotational direction. Mechanical elements to facilitate the aforementioned directional movements of the second housing 30 with respect to the first housing 10 are contemplated within the scope of the present invention. It should be understood within the scope of the present invention that the first housing 10 and second housing 30 are sized so as to provide access to the first aperture 36 and second aperture 37 of the second housing 30 thus allowing water to flow thereinto in the operational mode of the present invention. Additionally, in the standby mode of the present invention the first aperture 36 and second aperture 37 of the second housing 30 is substantially closed so as to inhibit water flow thereinto and access to the impeller 60.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the claims.

What is claimed is:

1. A watercraft propulsion system operably coupled to a watercraft and configured to provide propulsion thereof comprising:

a watercraft;

a propulsion system, said propulsion system operably coupled to said watercraft, said propulsion system having a housing assembly, said housing assembly including a first housing and a second housing, said first housing and said second housing being movably coupled, said first housing and said second housing being cylindrical in shape, said first housing having an interior volume, said second housing having an interior volume, said first housing being of suitable diameter so as to be disposed within the interior volume of said second housing, said first housing including at least one aperture, said second housing including at least one aperture;

a motor, said motor being disposed within said housing assembly, said motor having an impeller operably coupled thereto; and wherein the watercraft propulsion system is configured to have an operational mode and a standby mode wherein in said operational mode said at least one aperture of said first housing and said at least one aperture of said second housing are aligned so as to allow water to flow thereinto.

2. The watercraft propulsion system as recited in claim 1, wherein in said standby mode the at least one aperture of said first housing and said at least one aperture of said second housing are offset so as to inhibit water flow thereinto.

3. The watercraft propulsion system as recited in claim 2, wherein the first housing and the second housing are movable with respect to each other in a first direction or a second direction.

4. The watercraft propulsion system as recited in claim 3, wherein in said first direction said first housing and said second housing are movable in a linear direction with respect to each other.

5. The watercraft propulsion system as recited in claim 3, wherein said second direction said first housing and said second housing are movable in a rotational direction with respect to each other.

6. The watercraft propulsion system as recited in claim 5, wherein the watercraft is a surfboard.

7. The watercraft propulsion system as recited in claim 6, wherein the surfboard further includes a hydrofoil assembly.

8. A watercraft propulsion system operably coupled to a watercraft providing power thereto wherein the watercraft propulsion system includes an operational mode and a standby mode and the watercraft propulsion system comprises:

a watercraft, said watercraft configured to accommodate at least one passenger;

a propulsion system, said propulsion system operably coupled to said watercraft, said propulsion system having a housing assembly, said housing assembly including a first housing and a second housing, said first housing and said second housing being movably coupled, said first housing and said second housing being cylindrical in shape, said first housing having an interior volume, said second housing having an interior volume, said first housing being of suitable diameter so as to be disposed within the interior volume of said second housing, said first housing having a first portion and a second portion, said first portion and said second portion having at least one support member therebetween, said at least one support member having at least one aperture adjacent thereto, said second housing having a first portion and a second portion with at least one structural member intermediate thereto, said second housing having at least one aperture adjacent said at least one structural member;

a motor, said motor being disposed within said interior volume of said first housing of said housing assembly, said motor being a direct current electric motor, said motor having an impeller operably coupled thereto, said motor configured to provide rotational movement of said impeller; and wherein the operational mode and the standby mode provide alternate positions of the first housing relative to the second housing.

9. The watercraft propulsion system as recited in claim 8, wherein in said operational mode said first housing and said second housing being positioned relative to each other such that said at least one aperture of said first housing and said at least one aperture of said second housing are substantially aligned so as to allow water to flow into the interior volume of said first housing and said second housing.

10. The watercraft propulsion system as recited in claim 9, wherein in said standby mode said first housing and said second housing being positioned relative to each other such that said at least one aperture of said first housing and said at least one aperture of said second housing are offset so as to inhibit water flow into the interior volume of said first housing and said second housing.

11. The watercraft propulsion system as recited in claim 10, wherein said first housing and said second housing are movable with respect to each other in a first direction and a second direction, wherein said first direction is linear.

12. The watercraft propulsion system as recited in claim 11, wherein said second housing further includes a nozzle, said nozzle being operably coupled to said second portion distal to said at least one structural member.

13. The watercraft propulsion system as recited in claim 12, wherein said second direction said second housing is rotatable relative to said first housing.

14. The watercraft propulsion system as recited in claim 13, wherein said watercraft is a surfboard having a hydrofoil assembly.

15. A watercraft propulsion system operably coupled to a watercraft providing power thereto wherein the watercraft propulsion system includes an operational mode and a standby mode and the watercraft propulsion system comprises:

a watercraft, said watercraft configured to accommodate at least one passenger;

a propulsion system, said propulsion system operably coupled to said watercraft, said propulsion system having a housing assembly, said housing assembly including a first housing and a second housing, said first housing and said second housing being movably coupled, said first housing and said second housing being cylindrical in shape, said first housing having an interior volume, said second housing having an interior volume, said first housing being of suitable diameter so as to be disposed within the interior volume of said second housing, said first housing having a first portion and a second portion, said first portion and said second portion having two support members therebetween, said two support members being diametrically opposed, said first housing having two apertures adjacent said two support members, said two apertures providing access to said interior volume of said first housing, said second housing having a first portion and a second portion with two structural members intermediate thereto, said two structural members being diametrically opposed on said second housing, said second housing having two apertures adjacent said two structural members, said two apertures providing access to said interior volume of said second housing;

a motor, said motor being disposed within said interior volume of said first housing of said housing assembly, said motor being a direct current electric motor, said motor having an impeller operably coupled thereto, said motor configured to provide rotational movement of said impeller; and wherein the operational mode and the standby mode provide alternate positions of the first housing relative to the second housing.

16. The watercraft propulsion system as recited in claim 15, wherein the first housing and said second housing are movable in a first direction and a second direction with respect to each other.

17. The watercraft propulsion system as recited in claim 16, wherein in said operational mode said first housing and said second housing being positioned relative to each other such that said two apertures of said first housing and said two apertures of said second housing are substantially aligned so as to allow water to flow into the interior volume of said first housing and said second housing.

18. The watercraft propulsion system as recited in claim 16, wherein in said standby mode said first housing and said second housing being positioned relative to each other such that said two apertures of said first housing and said two apertures of said second housing are offset so as to inhibit water flow into the interior volume of said first housing and said second housing.

19. The watercraft propulsion system as recited in claim 16, wherein said second direction said second housing is rotatable relative to said first housing and in said first direction said second housing is linearly movable with respect to said first housing.

20. The watercraft propulsion system as recited in claim 16, wherein said watercraft is a surfboard having a hydrofoil assembly.

* * * * *